US009697974B2

(12) United States Patent
Mitschele et al.

(10) Patent No.: US 9,697,974 B2
(45) Date of Patent: Jul. 4, 2017

(54) TEMPERATURE-DEPENDENT SWITCH COMPRISING A SPACER RING

(71) Applicant: Thermik Geraetebau GmbH, Sondershausen (DE)

(72) Inventors: Rainer Mitschele, Straubenhardt (DE); Hans-Christian Liehr, Sangerhausen (DE)

(73) Assignee: THERMIK GERAETEBAU GMBH, Sondershausen (DE)

( * ) Notice: Subject to any disclaimer, the term of this patent is extended or adjusted under 35 U.S.C. 154(b) by 0 days.

(21) Appl. No.: 14/734,352

(22) Filed: Jun. 9, 2015

(65) Prior Publication Data

US 2015/0364284 A1 Dec. 17, 2015

(30) Foreign Application Priority Data

Jun. 17, 2014 (DE) ..... 10 2014 108 518

(51) Int. Cl.
*H01H 61/04* (2006.01)
*H01H 5/04* (2006.01)
(Continued)

(52) U.S. Cl.
CPC ..... *H01H 61/04* (2013.01); *H01H 1/58* (2013.01); *H01H 5/04* (2013.01); *H01H 37/54* (2013.01); *H01H 37/5427* (2013.01)

(58) Field of Classification Search
CPC H01H 1/58; H01H 37/54; H01H 5/04; H01H 61/04; H01H 37/5427
(Continued)

(56) References Cited

U.S. PATENT DOCUMENTS 3,579,167 A 5/1971 Grable
3,636,491 A * 1/1972 Cameron ..... H01H 85/303 337/161
(Continued)

FOREIGN PATENT DOCUMENTS

AT 256 225 B 8/1967
DE 977187 C 9/1956
(Continued)

OTHER PUBLICATIONS

AMP Standard Terminals and Splices, Caralog 82042, Tyco Electronics, Jul. 2008.*
European Search Report dated Oct. 30, 2015; 4 pp.

*Primary Examiner* — Anatoly Vortman
(74) *Attorney, Agent, or Firm* — Harness, Dickey & Pierce, P.L.C.

(57) ABSTRACT

A temperature-dependent switch has a temperature-dependent switching mechanism arranged in a housing having an upper part and a lower part. A first contact area is arranged on an inner side of the upper part and a second contact area is arranged internally in the lower part. The switching mechanism comprises a current transfer element, a bimetallic snap-action disc and a movable contact area. The moveable contact area is connected to the current transfer element and interacts with the first contact area, the bimetallic snap-action disc lifting off the movable contact area from the first contact area depending on the temperature of the bimetallic snap-action disc. A resistance ring is arranged between the upper part and the lower part and is electrically in series with the current transfer element between the first and second contact areas when the switch is in its closed state.

19 Claims, 3 Drawing Sheets

(51) Int. Cl.
*H01H 1/58* (2006.01)
*H01H 37/54* (2006.01)

(58) Field of Classification Search
USPC ..... 337/111
See application file for complete search history.

(56) References Cited

U.S. PATENT DOCUMENTS 4,371,230 A * 2/1983 Inoue ..... H01R 11/12 439/849
4,470,033 A * 9/1984 Hofsass ..... H01H 37/5427 337/343
4,849,729 A * 7/1989 Hofsass ..... H01H 37/5427 337/102
5,023,744 A * 6/1991 Hofsass ..... H01H 1/504 337/365
5,043,690 A * 8/1991 Wahls ..... H01H 37/54 337/342
5,615,072 A * 3/1997 Hofsass ..... H01H 1/504 337/107
5,670,930 A 9/1997 Hofsäss et al.
5,757,261 A 5/1998 Becher et al.
5,835,001 A * 11/1998 Hofsass ..... H01H 1/504 337/104
5,877,609 A * 3/1999 Carter ..... H01M 2/305 320/103
5,892,429 A * 4/1999 Hofsass ..... H01H 1/504 337/102
5,903,210 A * 5/1999 Hofsass ..... H01H 37/64 337/333
5,973,587 A * 10/1999 Hofsass ..... H01H 1/504 337/333
6,249,211 B1 6/2001 Hofsaess
7,125,295 B2 * 10/2006 Zhao ..... H01R 11/12 439/287
7,553,200 B2 * 6/2009 Plummer ..... H01R 4/304 439/766
2007/0080757 A1 * 4/2007 Yahata ..... H03H 9/0571 333/133
2014/0320257 A1 10/2014 Hofsaess
2015/0042443 A1 * 2/2015 Mitschele ..... H01H 37/34 337/365
2015/0061818 A1 * 3/2015 Klaschewski ..... H01H 37/54 337/343
2015/0109092 A1 4/2015 Neumann

FOREIGN PATENT DOCUMENTS

DE 1 690 287 3/1972
DE 21 21 802 A1 1/1973
DE 26 44 411 A1 4/1978
DE 43 45 350 C2 5/1995
DE 195 27 253 B4 1/1997
DE 196 04 939 C2 8/1997
DE 198 27 113 A1 12/1999
DE 10 2011 119 637 A1 5/2013
DE 10 2013 017 232 A1 4/2015
GB 1133030 11/1968

* cited by examiner

TEMPERATURE-DEPENDENT SWITCH COMPRISING A SPACER RING

CROSS-REFERENCES TO RELATED APPLICATION

This application claims priority to German patent application DE 10 2014 108 518, filed Jun. 17, 2014, which is incorporated herein by reference.

BACKGROUND OF THE INVENTION

The present invention relates to a temperature-dependent switch, which has a temperature-dependent switching mechanism and a housing which accommodates the switching mechanism and comprises an upper part and a lower part, wherein a first contact area is provided on an inner side of the upper part and a second contact area is provided internally in the lower part, the switching mechanism produces, in temperature-dependent fashion, an electrically conductive connection between the first and second contact areas, the switching mechanism comprises a current transfer element, a bimetallic snap-action disc and a movable contact area, said movable contact area being connected to the current transfer element and interacting with the first contact area, and wherein the bimetallic snap-action disc lifts off the movable contact area from the first contact area depending on the temperature of said bimetallic snap-action disc.

Such a switch is known from DE 10 2011 119 637 A1.

The known switch has a pot-like lower part, which is closed by an upper part engaging over the lower part. A temperature-dependent switching mechanism is arranged in the interior of the switch, said switching mechanism bearing a movable contact part, on which a movable contact area is provided, said contact area interacting with a stationary mating contact, which mating contact is arranged on an inner side of the upper part and forms a first contact area. The first contact area can also be formed directly on an inner side of the upper part.

The switching mechanism comprises, as current transfer element, a spring snap-action disc, which bears the movable contact part and presses said contact part against the stationary mating contact. In the process, the spring snap-action disc is supported with its rim on the inner base of the lower part, which forms the second contact area. In this position, the two contact areas are therefore electrically conductively connected to one another via the movable contact part and the spring snap-action disc.

Contact is made with the known switch from the outside via the electrically conductive cover part, which is electrically conductively connected to the stationary mating contact, and the likewise electrically conductive lower part, with the spring snap-action disc being supported on the inner base thereof.

A bimetallic snap-action disc which lies loosely in the switching mechanism in the low-temperature position of said bimetallic snap-action disc, is arranged above the spring snap-action disc. If the temperature of the bimetallic snap-action disc increases to a value above its response temperature, it presses, with its center, the movable contact part and therefore the movable contact area away from the stationary mating contact, for which purpose it is supported with its rim on an insulating film, which is provided between the lower part and the upper part. The spring snap-action disc in the process snaps over from its one stable geometric configuration to its other stable geometric configuration.

While in the embodiment described to this extent the spring snap-action disc operates against the bimetallic snap-action disc, in the case of the switch known from DE 10 2011 119 637 A1 provision is also made for only a bimetallic snap-action disc to be used, so that the current flows directly through the bimetallic snap-action disc, which also effects the contact pressure between the movable contact part and the stationary mating contact when the switch is closed.

Snap-action discs of the type used here are slightly curved discs with a center which is slightly raised with respect to the rim. The snap-action discs are generally round, circular, oval or similarly rounded, but can also be star-shaped or cross-shaped.

Bimetallic snap-action discs have a high-temperature position, in which they are convex in one view, while they appear concave in the same view when they are in their low-temperature position.

Spring snap-action discs, on the other hand, have two mechanically stable geometric positions or configurations, which appear to be convex or concave depending on the view.

Snap-action discs snap over from their one configuration to the other configuration by virtue of their center moving so to speak through the rim, which strives to perform a radial evasive movement in the process. If the rim is clamped in fixedly, this snapping-over process takes place over internal deformations whilst overcoming internal forces. These internal deformations and the internal forces occurring in the process result in mechanical loading and ageing of the snap-action discs, which limits the life of the switches equipped with said snap-action discs.

In order to avoid or at least significantly reduce the occurrence of the internal deformations and internal forces, the snap-action discs are therefore often prevented from being clamped in mechanically at their rim.

In the switch known from DE 10 2011 119 637 A1, the snap-action disc bearing the movable contact part is, for example, a circular disc, which has an inner contact region, onto which the movable contact part is welded. In order to avoid internal distortions in the snap-action disc, the inner contact region is separated from the snap-action disc by a semicircular gap, which extends over an angle of more than 180°.

A connecting web is formed integrally on the outer rim of the snap-action disc, said connecting web acting, together with the rest of the rim, as second contact region. This connecting web is used for better manipulation of the switching mechanism during fitting thereof and during insertion into the lower part. The connecting web is then welded flat onto the inner base of the lower part in order to ensure a permanent electrical and mechanical connection between the snap-action disc and the second contact area internally in the lower part. The second contact region is thus connected to the second contact area permanently in the region of the connecting web and in the region of the rim when the switch is closed.

This design provides the advantage that the material and production costs for the known temperature-dependent switch are lower than for other switches because no rotary part is required as the lower part and because it is possible to dispense with silver-plating both for the snap-action disc and for the lower part. On the other hand, the complexity involved in fitting is greater than in the case of switches into which the temperature-dependent switching mechanism is merely inserted, as is known from DE 43 45 350 C2.

Owing to the permanent galvanic connection between the snap-action disc and the second contact area, in the switch known from DE 10 2011 119 637 A1 it is ensured that the contact resistance between the snap-action disc and the lower part is very low. In this way, a possible source of faults is eliminated, which may crop up during final continuity testing of a ready-fitted temperature-dependent switch. That is to say that it is quite possible for the contact resistance between the lower part of the housing and the snap-action disc to be so great owing to manufacturing tolerances that the finished temperature-dependent switch needs to be disposed of as a reject.

In a conventional manner, temperature-dependent switches of the type mentioned at the outset are provided with snap-action discs, however, which rest with their rim loosely, i.e. freely movably, on the inner base of the lower part or a shoulder running peripherally internally in the lower part, so that the entire rim forms an outer contact region. Such switches are known, for example, from the above-mentioned DE 43 45 350 A1. During snapping over from one geometric configuration into the other, the snap-action disc is extended until its rim, as it snaps over, lifts off from the base of the lower part or the peripheral rim.

Owing to the fact that the spring snap-action disc is supported on a peripheral shoulder in the switch known from DE 43 45 350 A1, during snap-over it can move with its center "through" the shoulder and its rim resting on the shoulder towards the base which is further below, i.e. snap through the rim while at the same time it extends mechanically radially outwards, which enables snap-over without external mechanical counterforces needing to be overcome.

These mechanical degrees of freedom during snap-over between the two geometric configurations are desirable since they have a positive effect on the life of the switching mechanism and the long-term constancy of the switching temperature.

In order to meet the physical heights and/or the desired function of the individual component parts of such a switch, it is known to arrange a spacer ring between the upper part and the lower part, said spacer ring providing the corresponding accommodating area in the interior of the switch, depending on the height of the temperature-dependent switching mechanism. In accordance with DE 195 27 253 B4, the spacer ring can be in the form of an insulator or a heating resistor, which resistor is electrically connected both to the upper part and to the lower part. This heating resistor is then used for self-holding, as will be described in more detail further below.

Although the switch known from DE 10 2011 119 637 A1 has many advantages in respect of costs and fitting, it does have certain disadvantages as regards the life of the switching mechanism and the long-term constancy of the switching temperature because the snap-action disc is connected mechanically fixedly to the inner base of the lower part via the connecting web at a point on its circumference. This design enables neither radial extension nor unimpeded snap-through of the center of the snap-action disc which is therefore subject to external mechanical forces as it springs over.

The known temperature-dependent switches serve the purpose of protecting an electrical device from an excessively high temperature. For this purpose, the supply current for the device to be protected is conducted through the temperature-dependent switch, wherein the switch is thermally coupled to the device to be protected. At a response temperature which is preset by the snap-over temperature of the bimetallic snap-action disc, the respective switching mechanism then opens the circuit by virtue of the movable contact area being lifted off from the stationary mating contact.

The movable contact area can in this case be formed on a contact part moved by the snap-action disc or directly on the snap-action disc.

In order that the switch does not close again after cooling-down of the device, it is known, for example, from the above-cited DE 195 27 253 B4, to provide a self-holding resistor, preferably a PTC thermistor, in parallel with the temperature-dependent switching mechanism, said self-holding resistor being electrically short-circuited by the temperature-dependent switching mechanism when said switching mechanism is closed. If the switching mechanism now opens, the self-holding resistor takes over part of the current previously flowing and in the process is heated to such an extent that it generates sufficient heat to keep the bimetallic snap-action disc at a temperature which is above the response temperature. This procedure is referred to as self-holding and prevents a temperature-dependent switch from closing again in an uncontrolled manner when the device to be protected cools down again.

While self-heating of the snap-action disc owing to the flowing current is often undesirable in the case of such temperature-dependent switches, switches are also known in which, in addition, a series resistor is provided, which is heated in a defined manner by the flowing operating current of the device to be protected. In the case of an excessively high current flow, this series resistor heats up to such an extent that the critical temperature of the bimetallic snap-action disc is reached. In addition to monitoring of the temperature of the device to be protected, the current flowing can also be monitored in this way, and the switch then has a defined current dependence.

Such switches have stood the test sufficiently well in everyday use. If the switches do not open at the zero crossing of an AC supply voltage or when a DC voltage is applied, arcs form when the movable contact part lifts off from the stationary mating contact and/or when the rim of the current-conducting snap-action disc lifts off from the second contact area and sparks fly.

The arcs formed and sparks produced result in contact erosion and, associated with this over the long term, a change in the geometry of the switching areas of the movable contact part and the stationary mating contact, which, over time, also results in an increase in the volume resistance.

In addition to the contact erosion at the stationary mating contact and the movable contact part, contact erosion also occurs at the contact points where contact resistances form, i.e. between the rim of the snap-action discs, which bear the movable contact part, and the second contact area internally in the housing lower part. Over the course of the switching cycles, this likewise results in an increase in the volume resistance, owing to damage to the rim of the snap-action discs, but this volume resistance should be kept as low as possible in order to keep an undefined influence, which changes over the course of the switching cycles, of the current self-heating on the switching behavior as small as possible.

In particular in the case of high switched currents of, for example, 20 to 50 amperes, the material in the region of the contact resistances is heated considerably, with the result that, owing to the low-resistance design of the switch, the essential heat sources are often not the heat of the component part to be protected but the transfer resistances. As a result, the contact erosion at the contacts and contact areas which are heated in any case increases considerably.

These problems increase even more as the number of switching cycles increases, with the result that the switching behavior of the known switches is impaired over the course of time. Against this background, the life, i.e. the number of permissible switching cycles of the known switches, is limited, wherein the life is also dependent on the contact interruption rating, i.e. the current intensity of the switched currents.

DE 977 187 A therefore proposes that, in the case of a temperature-dependent switching mechanism which has only one bimetallic snap-action disc, said bimetallic snap-action disc is relieved of current flow by virtue of the fact that the movable contact part is connected to the housing of the switch via a sun wheel-shaped metal spider. In this way, the current no longer flows through the bimetallic snap-action disc, but predominantly through the metal spider.

A similar approach is used in AT 256 225 A, in which a copper branching is provided on that surface of the bimetallic snap-action disc which is remote from the stationary mating contact, said copper branching connecting the movable contact part to the housing.

The copper branching and the metal spider do not in any way contribute to the mechanical operation of the switch; in contrast, they need to be moved along by the bimetallic snap-action disc during opening and closing of the switch, i.e. they represent additional mechanical loading for said bimetallic snap-action disc. This results in fatigue and, associated with this, not only an undesired shift in the switching temperature, but also in an impaired opening and closing behavior, which considerably limits the life.

In the case of these switches, the bimetallic snap-action disc does also need to provide the closing pressure of the switching mechanism, but this mechanical loading can be accepted in certain switch types.

Against this background, DE 21 21 802 A proposes arranging a spring snap-action disc in parallel with the bimetallic snap-action disc, said spring snap-action disc producing the closing pressure of the switching mechanism and assisting the snap-over movement of the bimetallic snap-action disc both during opening and during closing. In addition, it also conducts the electrical current. In this way, the bimetallic snap-action disc is relieved of both mechanical and electrical load, with the result that its life is markedly extended.

In the case of this switch there is the problem outlined already at the outset on the basis of the switch known from DE 43 45 350 A1 in respect of the unavoidably forming arcs and sparks which limit the life of the known switches ever more the higher the switched current is.

In the case of the switch known from DE 10 2011 119 637 A1, the contact erosion at the rim of the snap-action disc is reduced by the permanent electrical connection between the snap-action disc and the second contact area, but nevertheless current flows not only via the connecting web but also via the rim of the snap-action disc into the second contact area when the switch is closed, i.e. when the rim of the snap-action disc is supported on the second contact area, with the result that the rim is damaged by contact erosion during opening of the switch, which does not impair the volume resistance, but does impair the mechanical switching behavior and therefore the life.

In order to be able to conduct higher currents via temperature-dependent switches which nevertheless have a long life, a current transfer element in the form of a contact bridge or a contact plate is therefore often used, which is moved by a bimetallic or spring snap-action disc and bears two contact parts, which interact with two stationary mating contacts.

In this way, the operating current of the device to be protected flows from the first mating contact via the first contact part into the contact plate, through said contact plate to the second contact part and from said second contact part into the second mating contact. The snap-action disc is thus free of current and the above-mentioned problems with contact erosion at the rims of the snap-action discs are avoided. However, these switches, as are known from DE 26 44 411 A1 or DE 198 27 113 A1, for example, have a greater physical height than the generic switches and are more complex in design terms.

SUMMARY OF THE INVENTION

In view of the above, it is among others one object of the present invention to provide, in a manner which is simple in design terms, a temperature-dependent switch of the type mentioned at the outset which is easy to fit and still has a sufficient life for conventional application cases even in the case of high switched currents.

In accordance with the invention, this and other objects are achieved by the fact that a resistance ring is arranged between the upper part and the lower part and is electrically in series with the current transfer element between the first and second contact areas when the switch is closed.

In this way, the switching current also flows through the resistance ring and generates ohmic heat there. The resistance value of the resistance ring can then be configured in relation to the contact resistances such that the majority of the heat in the switch is produced in said resistance ring. The contacts and contact areas at the contact resistances therefore no longer heat up as much as is the case in comparably designed switches without the resistance ring.

By virtue of the selection of the resistance value of the resistance ring, it is now possible to implement current-dependent switching, i.e. a defined current dependence, in a manner which is simple in design terms.

The novel switch is additionally easier to assemble than the switch known from DE 10 2011 119 637 A1.

Another advantage consists in that in the case of the novel switch, despite a simple design and simple fitting there is markedly less contact erosion at the rims of the snap-action discs than in the switch known from DE 43 45 350 A1.

The life of the known switches is thus markedly extended, which was not expected and was surprising.

The contact erosion at the rim of the snap-action discs, in accordance with a preliminary and non-binding interpretation of the inventors of the present application, results in the maximum switching power and the achievable switching cycle number being limited to a greater extent than as a result of the contact erosion at the stationary mating contact and the movable contact part. Even owing to the resistance ring alone, an improvement in the contact erosion at the rim of the current-conducting snap-action discs results, and therefore, contrary to expectations, the life of a temperature-dependent switch is increased.

According to one embodiment, the resistance ring comprises an upper ring area and a lower ring area, the current transfer element has a rim, which rests on the upper ring area, and the lower ring area rests indirectly or directly on the second contact area.

This measure is advantageous in design terms since, during fitting of the novel switch, only the resistance ring needs to be inserted into the lower part, which rests on the second contact area either directly or with a spring snap-action disc interposed, for example, as will be described further below. The current transfer element is then positioned onto the resistance ring, and said current transfer element is then possibly pressed onto the upper ring area with its rim by a spacer ring being positioned.

In this way, only very low contact resistances occur between the rim of the current transfer element and the upper ring area and between the lower ring area and the second contact area, which reduces the risk of contact erosion. In addition, the rim of the current transfer element does not lift off from the upper ring area during opening of the switch, which likewise reduces contact erosion.

According to a further embodiment, a spacer ring is arranged between the rim of the current transfer element and the upper part, and in that the rim of the current transfer element is fixed between the spacer ring and the resistance ring.

Further, the current transfer element may be in the form of a spring snap-action disc.

It is advantageous here that the bimetallic snap-action disc is relieved of mechanical load, and that a conventional temperature-dependent switching mechanism comprising a movable contact part, a spring snap-action disc and a bimetallic snap-action disc can be used.

According to one embodiment, the switching mechanism comprises, in addition to the current transfer element, a spring snap-action disc, which bears the movable contact part.

Therefore, the switching mechanism comprises, in addition to the components which are generally provided, namely the movable contact part, the spring snap-action disc and the bimetallic snap-action disc, also a current transfer element, so that not only the bimetallic snap-action disc is generally relieved of mechanical load by the spring snap-action disc, but, in accordance with the invention, the spring snap-action disc is at least largely relieved of load from the conduction of current by the series circuit comprising the current transfer element and the resistance ring. The spring snap-action disc can also be relieved of current conduction entirely if it is electrically insulated with its rim with respect to the second contact area and/or with its center with respect to the movable contact part.

The spring snap-action disc may be arranged between the current transfer element and the bimetallic snap-action disc, further preferably the spring snap-action disc has a rim, which is held between the resistance ring and the second contact area.

A "held" rim within the context of the present application is understood to mean both clamping-in and fixing of the rim such that it is made possible for the spring snap-action disc to expand as it snaps over, i.e. to move outwards with its rim, as has already been explained at the outset.

In this way, the spring snap-action disc can be connected electrically in parallel with the series circuit comprising the current transfer element and the resistance ring.

According to one embodiment, the spring snap-action disc has a greater electrical resistance than the series circuit comprising the current transfer element and the resistance ring, and may be manufactured from stainless steel, wherein the current transfer element may consist of a material that has a lower specific electrical resistance than the spring snap-action disc, and may have a coating which improves the conductivity, for example a silver coating.

In this case, it is first advantageous that an inexpensive material without any additional coating, for example with silver, can be used for the spring snap-action disc.

In this way, in addition the current divider formed by the spring snap-action disc, on the one hand, and the series circuit comprising the current transfer element and the resistance ring, on the other hand, is designed in such a way that the majority of the operating current of the device to be protected flows through the series circuit comprising the current transfer element and the resistance ring.

The heat generated in the resistance ring is thus transferred directly into the housing of the switch and therefore to the bimetallic snap-action disc, as a result of which the response time of the switch is reduced, the contacts and contact areas remain colder, and the life is increased.

Tests performed by the applicant have shown that the novel switch withstands more than 3000 switching cycles at a switching current of 25 A without the operation being impaired. Such a long life at such a high switching current has previously not been expected for a switch of the generic type, even not in the case of a design with a movable contact part, a spring snap-action disc and a bimetallic snap-action disc and current transfer element, but still without a resistance ring.

The resistance of the spring snap-action disc produced from stainless steel is 150 mΩ, for example, and the resistance of the current transfer element in the form of a current transfer disc is a few mΩ. The resistance of the resistance ring between the two ring areas should be 10 to 15 mΩ.

The current transfer element is preferably in the form of a disc and in this case preferably has bent slots extending radially outwards.

These slots reduce the spring effect of the current transfer disc, with the result that it does not counteract the spring force of the bimetallic snap-action disc and that of the spring snap-action disc during switching.

The resistance ring may be manufactured from a metal or a metal alloy, and has a specific electrical resistance at 20° C. which is greater than that of copper.

Such a resistance ring would possibly have an excessively low volume resistance between the two ring areas, however, for which reason it is preferred if the upper ring area in a first section and the lower ring area in a second section are provided with an electrically conductive coating, which has a lower specific electrical resistance than the material of the resistance ring, wherein further preferably the resistance ring has an ohmic resistance of between 2 and 50 mΩ, preferably between 5 and 30 mΩ, between the first and second sections, and further preferably the first and/or second sections cover less than 50%, preferably less than 35% of the respective ring area.

In this technically simple way, resistance values between the two sections in the desired range can be realized. The current does not flow along the thickness of the resistance ring, but primarily along the diameter. With a given material, the resistance value is fixed by the proportion of the area of the coated sections on the respective ring area.

The present invention also relates to a resistance ring for a temperature-dependent switch, which has an upper ring area and a lower ring area, is manufactured from a material, preferably from a metal or a metal alloy, and has a specific electrical resistance at 20° C. that is greater than that of copper, wherein the upper ring area in a first section and the lower ring area in a second section are provided with an electrically conductive coating, which has a lower specific electrical resistance than the material of the resistance ring, wherein the first and/or second sections may cover less than 50%, and in one embodiment less than 35%, of the respective ring area, wherein the resistance ring may consist of an iron or copper alloy, of brass, bronze, constantan or stainless steel.

The coating may be a silver-containing coating, wherein the resistance ring may have an ohmic resistance of between 2 and 50 mΩ, preferably between 5 and 30 mΩ, between the first and second sections.

The resistance ring may have an outer diameter of between 8 and 20 mm, an inner diameter of between 5 and 10 mm and a thickness between the ring areas of between 0.1 and 0.5 mm.

Finally, the invention relates to the use of the novel resistance ring for manufacturing a temperature-dependent switch, preferably the novel switch.

The novel switch can additionally be provided with a parallel resistor for self-holding, in a manner known per se.

Further advantages are set forth in the description and the attached drawing.

It goes without saying that the features mentioned above and yet to be explained below can be used not only in the respectively cited combination, but also in other combinations or on their own without departing from the scope of the present invention.

BRIEF DESCRIPTION OF THE DRAWINGS

Embodiments of the invention are illustrated in the attached drawing and will be explained in more detail in the description below. In the drawing.

BRIEF DESCRIPTION OF THE PREFERRED EMBODIMENTS

Figure 1:
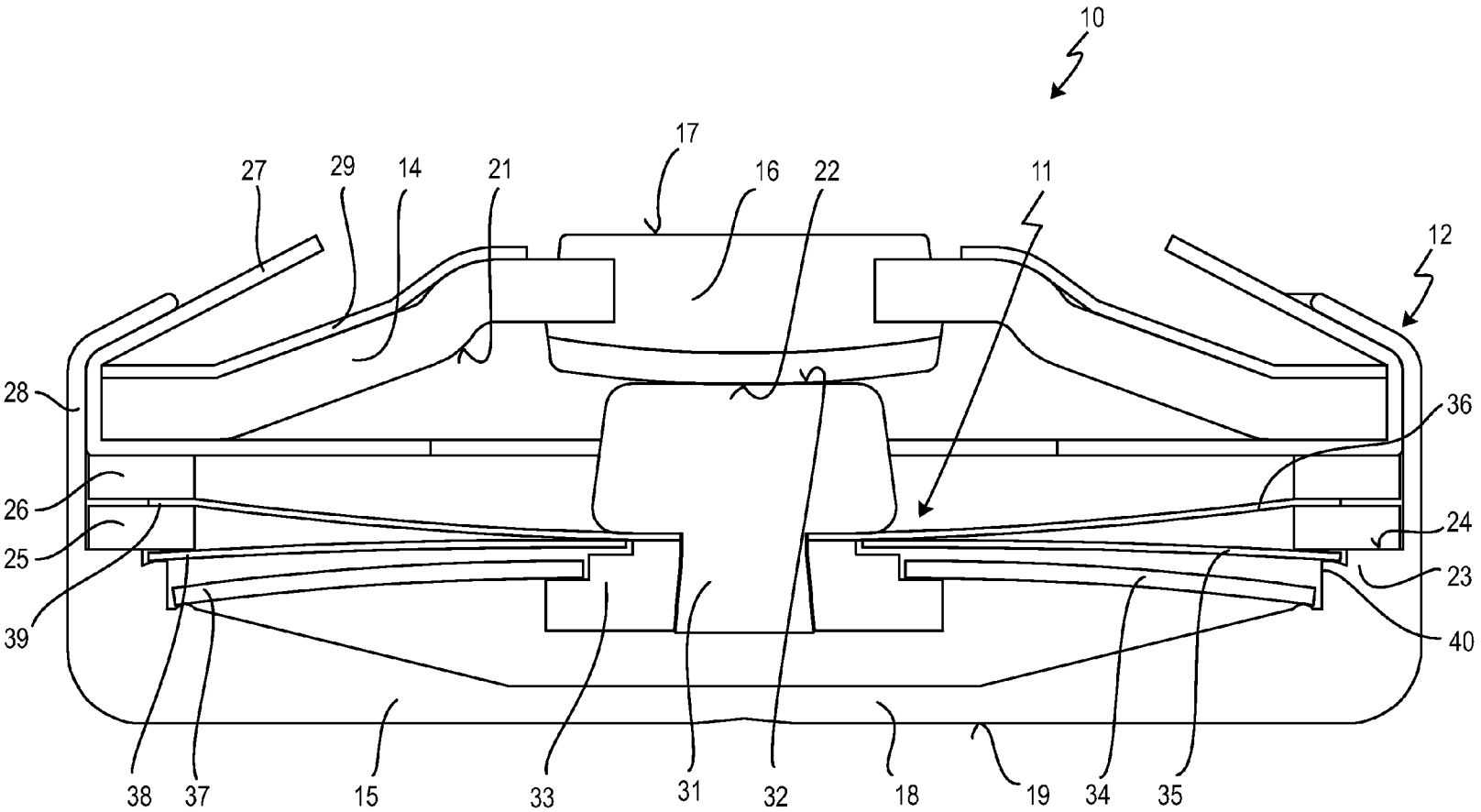
FIG. 1 shows a schematic, sectional side view of a temperature-dependent switch in the closed state.

FIG. 1 shows a schematic side view, which is not true to scale, of a temperature-dependent switch 10 that is in its closed state and is circular in plan view and has a temperature-dependent switching mechanism 11, which is arranged in a housing 12.

The housing 12 comprises an upper part 14, which closes a pot-like lower part 15.

The upper part 14 bears a stationary mating contact 16, whose outer side acts as first external connection 17 for the switch 10. The lower part 15 has a base 18, whose outer side acts as a second external connection 19 for the switch 10.

A first contact area 22 for the switching mechanism 11, which contact area 22 is formed on the stationary mating contact 16, is provided on an inner side 21 of the upper part 14.

A peripheral shoulder 23 is arranged in the lower part 15 and acts as second contact area 24 for the switching mechanism 11.

A resistance ring 25, which will be described in more detail, rests on the peripheral shoulder 23, and a spacer ring 26 is arranged on said resistance ring. An insulating film 27 rests on the spacer ring 26, with in turn the upper part 14 resting on said insulating film 27.

The insulating film 27 is drawn upwards between the upper part and a raised rim 28 of the lower part 14, where it is pressed by the flanged rim 28 towards the upper part 14.

Yet a further insulating film 29 is arranged on the upper part 14.

In this way, the shoulder 10 is hermetically sealed, the insulating films 27 and 29 ensure that neither dust nor moisture or other impurities can enter the interior of the switch 10 between the raised rim 28 and the upper part 14.

The electrically conductive upper part 14 and the electrically conductive lower part 15 are electrically insulated from one another by the insulating film 27, wherein an electrically conductive connection is produced between the first contact area 22 and the second contact area 24 by the temperature-dependent switching mechanism 10.

The switching mechanism 11 comprises, for this purpose, a movable contact part 31, on which a movable contact area 32 is provided, which points towards the first contact area 22. In the closed state of the switch 10, as is shown in FIG. 1, the first contact area 22 and the movable contact area 32 bear against one another.

The movable contact part 31 is mushroom-shaped in cross section, wherein a stepped holding ring 33 is positioned on the stalk, said holding ring bearing a bimetallic snap-action action disc 34, a spring snap-action disc 35 and a current transfer element 36.

The bimetallic snap-action disc 34 is supported with its rim 37 internally on the base 18 of the lower part 15.

The spring snap-action disc 35 lies with its rim 38 between the resistance ring 25 and a step 40 on the peripheral shoulder 23.

The current transfer element 36 is clamped in with its rim 39 between the resistance ring 25 and the spacer ring 26.

Figure 2:
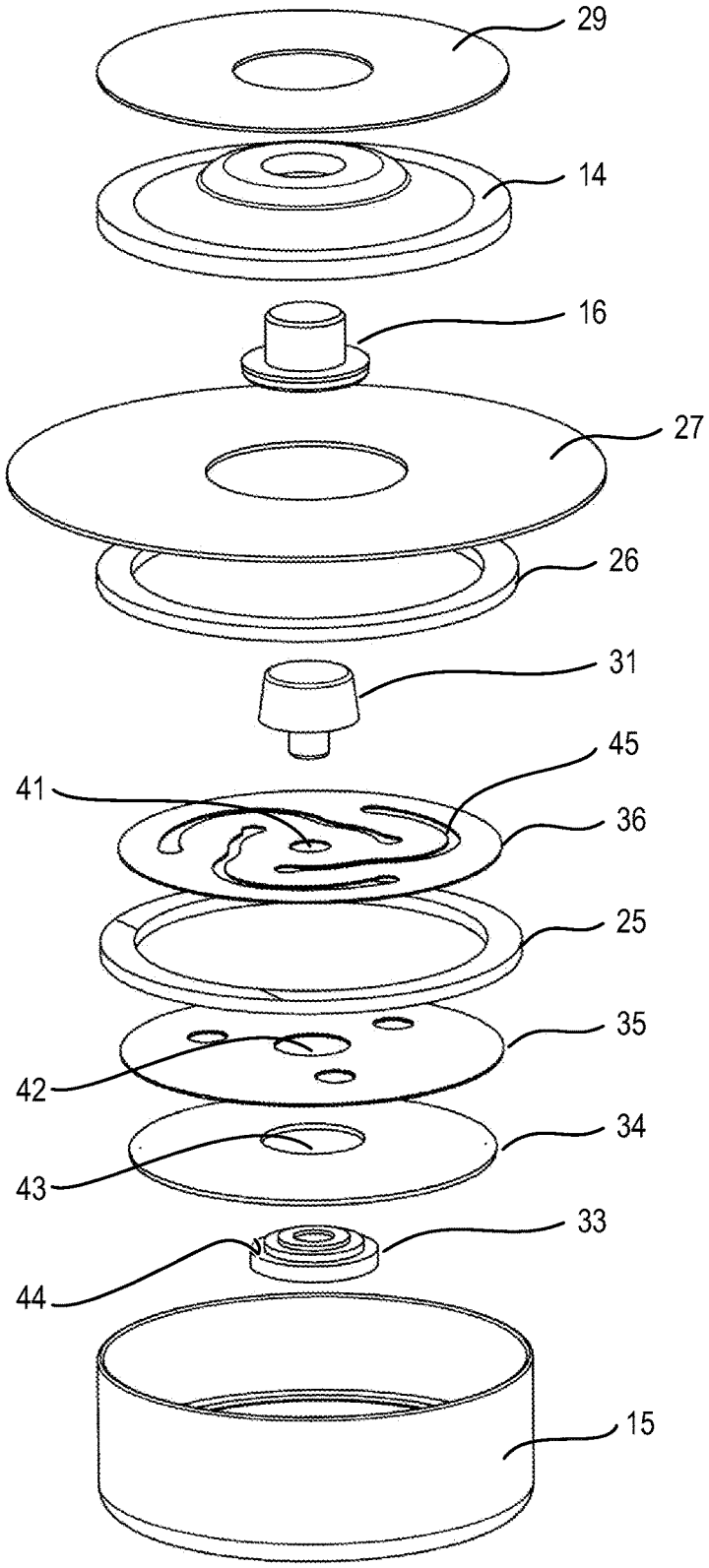
FIG. 2 shows an exploded illustration of the switch shown in FIG. 1.

FIG. 2 shows the switch in an exploded illustration, from which it can be seen that the bimetallic snap-action disc 34 and the spring snap-action disc 35 are in the form of circular discs, in precisely the same way as the current transfer element 36. Alternatively, these three component parts 34, 35 and 36 can also be oval or star-shaped or cross-shaped.

In the closed state of the switch 10 shown in FIG. 1, the spring snap-action disc 37 presses the movable contact part 31 against the stationary mating contact 16, with the result that the first contact area 22 and the movable contact area 32 bear mechanically against one another and are electrically conductively connected to one another.

Owing to the fact that the rim 38 of the spring snap-action disc 35 is supported on the shoulder 40, the spring snap-action disc 35 is electrically conductively connected to the second contact area 24.

When the switch 10 is closed as shown in FIG. 1, therefore, a first current path is formed between the stationary mating contact 16, the movable contact part 31, the spring snap-action disc 35 and the electrically conductive lower part 15.

A current path formed by the current transfer element 36 and the resistance ring 25 is connected in parallel with this current path, with the result that a current divider is formed.

The movable contact part 31 is namely also electrically connected to the current transfer element 36, which in turn rests with its rim 39 on the resistance ring 35, which in turn rests directly on the second contact area 24.

It can be seen in particular in FIG. 2 that the current transfer element 36, the spring snap-action disc 35 and the bimetallic snap-action disc 34 each have a central bore 41, 42 and 43, respectively, which rest on the steps of the holding ring 33.

While the current transfer element 36 and the spring snap-action disc 35 are clamped in electrically conductively and mechanically fixedly between the holding ring 33 and the movable contact part 31 via the openings 41 and 42 of said current transfer element and said spring snap-action disc, the bimetallic snap-action disc 34 rests with its opening 43 loosely on a lowermost step 44 of the holding ring 33.

As can also be seen from FIG. 2, the current transfer element 36 is furthermore provided with bent slots 45 extending radially outwards. These slots 45 mean that the current transfer element 36 does not have a mechanical spring effect, with the result that it does not influence, or only influences unnoticeably, the temperature-dependent switching operation of the temperature-dependent switching mechanism 11.

The switching mechanism 11 could alternatively also be designed in such a way that the spring snap-action disc 35 is moved to the position of the current transfer element 36, i.e. is clamped in with its rim 38 between the spacer ring 26 and the resistance ring 25. The current transfer element 36 would then be formed quasi by the spring snap-action disc 35, with the result that the switching mechanism 11 comprises the bimetallic snap-action disc 34 and a current transfer element 36, which now also takes on the function of a spring snap-action disc 35.

However, in the switching mechanism 11 shown in FIG. 1, the current transfer element 36 is used substantially for conducting current because the resistance of the series circuit comprising the current transfer element 36 and the resistance ring 25 is markedly lower than the resistance of the spring snap-action disc 35.

The spring snap-action disc 35 is used primarily to keep the switch closed, i.e. to exert the contact pressure with which the movable contact part 31 rests on the stationary mating contact 16.

The bimetallic snap-action disc 34 rests loosely on the step 44 in the closed position of the switch 10 shown in FIG. 1, i.e. is not in operation either electrically or mechanically.

If the temperature in the interior of the switch 10 increases, the temperature of the bimetallic snap-action disc 34 also increases, and the latter then moves upwards with its rim 37 and comes into bearing contact with the rim 38 of the spring snap-action disc 35. When the bimetallic snap-action disc 34 bends further, it then presses the movable contact part 31 downwards and in the process lifts off the movable contact area 32 from the first contact area 22, with the result that the switch 10 is opened.

During this opening movement, arcs can be produced between the movable contact part 31 and the stationary contact 16, wherein in addition sparks may also fly.

In addition, in the case of a switch which has neither a resistance ring 25 nor a current transfer element 36, sparking can also arise at the rim 38 of the spring snap-action disc 35.

As already described at the outset, the arc formation and in particular the sparking can result in contact erosion being caused at the contact areas 22 and 24 and at the movable contact area 32 and the rim 38 of the spring snap-action disc 35, which in particular in the case of relatively high currents limits the life, i.e. the number of permissible switching cycles of such a switch 10.

Owing to the fact that the switch 10 now has a resistance ring 25, whose resistance value is high in relation to the resistance of the current transfer element 36 and contact resistances between the contact areas 22 and 32 and the rims 38 and/or 39 of the spring snap-action disc 35 and/or the current transfer element 36, the majority of the heat in the switch 10 is now produced by the current flow through the resistance ring 25.

In this way, the contact areas at the thus described contact resistances are not heated as much, which already results in the contact erosion being markedly reduced.

Owing to the resistance of the resistance ring, the switch can thus also switch with a defined current dependence because the heat produced in the resistance ring 25 is conducted directly into the interior of the switch 10 and therefore towards the bimetallic snap-action disc 34.

This protective function is developed by the resistance ring 25 already in the case of a switching mechanism 11 which has a spring snap-action disc 35 as current transfer element 36.

However, the protective effect in the case of the embodiment shown in FIG. 1 is particularly efficient because the resistance of the spring snap-action disc 35 in relation to the resistance of the resistance ring 25 can be designed to be very high there, with the result that the majority of the operating current of the device to be protected flows through the series circuit comprising the current transfer element 36 and the resistance ring 25.

The spring snap-action disc is manufactured from stainless steel, for example, and does not have a silver coating, contrary to conventional practice, with the result that it has a resistance of 150 mΩ between its opening 42 and its rim 38.

The current transfer element 36, on the other hand, is manufactured from a copper alloy, for example, and is additionally provided with a silver coating, with the result that it has a resistance of a few mΩ between its opening 41 and its rim 39.

The resistance ring 25 is designed, in a manner yet to be described, in such a way that it has a resistance of from 5 to 15 mΩ to the current flow.

During continuous operation in the applicant's rooms, such a switch has withstood more than 3000 switching cycles at an operating current of 25 amperes, i.e. has demonstrated a capacity which otherwise only switches with a very complicated design having a contact bridge demonstrate, as are known, for example, from DE 26 44 411 A1 mentioned at the outset.

In other words, the spring snap-action disc has a higher electrical resistance than the series circuit comprising the current transfer element and the resistance ring.

The current transfer element 36 consists namely of a material which has a lower specific electrical resistance than the spring snap-action disc, wherein the current transfer element also has a coating with improved conductivity consisting of silver.

The resistance ring 25 consists of a material, in particular a metal or a metal alloy, which has a specific electrical resistance that is greater than that of copper at 20° C. The resistance ring 25 is manufactured from constantan, for example.

In order now to configure the resistance ring 25 in such a way that it has a resistance of from 5 to 15 mΩ between the rim 39 of the current transfer element 36 and the second contact area 24, said resistance ring is provided with a selective coating, as will now be explained with reference to FIG. 3.

Figure 3:
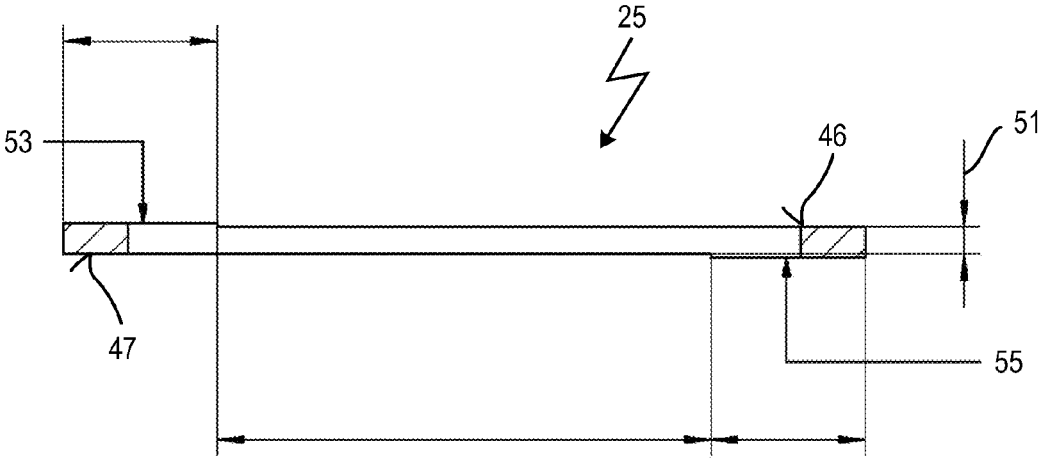
FIG. 3 shows the resistance ring from FIG. 2 in a schematic plan view and in section along the line A-A.
Figure 3:
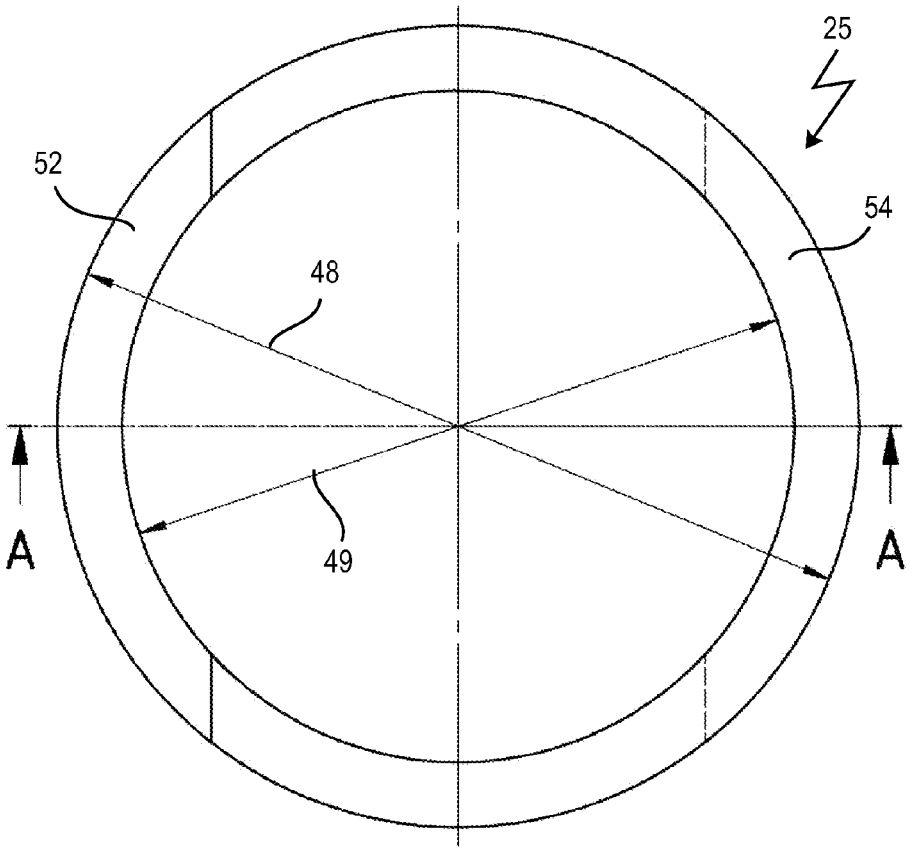

The resistance ring 25 is shown in plan view at the bottom in FIG. 3, and in section at the top in FIG. 3, along the line A-A from FIG. 3 at the bottom.

The resistance ring 25 has an upper ring area 46, on which the rim 39 of the current transfer element 36 rests.

In parallel therewith, the resistance ring 25 has a lower ring area 47, with which it rests directly on the second contact area 24.

The resistance ring 25 is ring-shaped with an outer diameter (indicated at 48) and an inner diameter (indicated at 49). The current transfer element 26 has a thickness (indicated at 51) between the two ring areas 46 and 47.

In the embodiment shown, the outer diameter 49 is approximately 10.5 mm, the inner diameter 49 is approximately 8.5 mm, and the thickness 51 is approximately 0.35 mm.

Spring sheet metal which has been coated selectively has been used as the material.

The upper ring area 46 is provided in a section 52 with a silver coating 53, while the lower ring area 47 is provided in a section 54 with a silver coating 55.

The two sections 52 and 54 are thus arranged on different ring areas 46, 47 and are circumferentially offset with respect to each other. In the embodiment shown, the first section 52 is offset with respect to the section 54 by 180° such that the two sections 52, 54 are diametrically opposed to each other. The two sections 52 and 54 each take up approximately a third of the total area of the respective ring area 46 and 47, respectively.

The operating current of a device to be protected now flows through the silver coating 53 or 55 from the rim 39 of the current transfer element 36 into the section 52 and from there so to speak longitudinally or circularly through the resistance ring 25 as far as the section 54, where the current enters the second contact area 24.

The resistance value between the sections 52 and 54 can thus be varied by virtue of the sizes of said two sections 52 and 54, for which reason volume resistances between 2 and 50 mΩ can be realized even in the case of a resistance ring 25 consisting of constantan with a thickness of only 0.35 mm.

Therefore, what is claimed is:

1. A temperature-dependent switch having a closed state, said switch comprising:

a temperature-dependent switching mechanism, said switching mechanism comprises a current transfer element, a bimetallic snap-action disc and a movable contact area connected to the current transfer element, a housing accommodating the switching mechanism and comprising an upper part with an inner side and a lower part, a resistance ring being arranged between said upper part and said lower part, a first contact area being provided on said inner side of said upper part, a second contact area being provided internally in the lower part, the switching mechanism producing, in temperature-dependent fashion, an electrically conductive connection between the first and second contact areas, said movable contact area interacting with said first contact area, the bimetallic snap-action disc lifting off the movable contact area from said first contact area depending on the temperature of said bimetallic snap-action disc, said resistance ring being arranged electrically in series with said current transfer element between said first and second contact areas when the switch is in its closed state, wherein the resistance ring comprises an upper ring area and a lower ring area, the current transfer element comprising a rim resting on the upper ring area, the lower ring area resting indirectly or directly on the second contact area, and wherein a spacer ring is arranged between said rim of said current transfer element and said upper part, said rim of said current transfer element being fixed between said spacer ring and said resistance ring.

2. The switch of claim 1, wherein the current transfer element is embodied as a spring snap-action disc.

3. The switch of claim 1, wherein the switching mechanism comprises, in addition to the current transfer element, a spring snap-action disc, which bears the movable contact area.

4. The switch of claim 3, wherein the spring snap-action disc is arranged between the current transfer element and the bimetallic snap-action disc.

5. The switch of claim 4, wherein the spring snap-action disc comprises a rim held between the resistance ring and the second contact area.

6. The switch of claim 3, wherein the spring snap-action disc has a greater electrical resistance than the series circuit comprised of the current transfer element and the resistance ring.

7. The switch of claim 3, wherein the current transfer element consists of a material that has a lower specific electrical resistance than the spring snap-action disc.

8. The switch of claim 3, wherein the current transfer element comprises a coating that improves conductivity.

9. The switch of claim 3, wherein the current transfer element comprises bent slots extending radially outwards.

10. The switch of claim 1, wherein the resistance ring is manufactured from a material having a specific electrical resistance at 20° C. which is greater than that of copper.

11. The switch of claim 1, wherein said upper ring area comprises a first section and said lower ring area comprises a second section, said first and second sections being provided with an electrically conductive coating having a lower specific electrical resistance than the material of the resistance ring.

12. The switch of claim 11, wherein the resistance ring has an ohmic resistance between the first and second sections of between 2 and 50 mΩ.

13. The switch of claim 11, wherein at least one of the first and second sections covers less than 50% of the respective ring area.

14. The switch of claim 11, wherein the first section is circumferentially offset with respect to the second section.

15. The switch of claim 11, wherein the resistance ring has an ohmic resistance between the first and second sections of between 5 and 30 mΩ, each of the first and second sections covers less than 35% of the respective ring area, and the first section is circumferentially offset with respect to the second section.

16. The switch of claim 11, wherein the coating comprises a silver-containing coating.

17. The switch of claim 1, wherein the resistance ring consists of a material selected from the group consisting of an iron alloy, a copper alloy, brass, bronze, constantan and stainless steel.

18. A temperature-dependent switch having a closed state, said switch comprising:

a temperature-dependent switching mechanism, said switching mechanism comprises a current transfer element, a bimetallic snap-action disc and a movable contact area connected to the current transfer element, a housing accommodating the switching mechanism and comprising an upper part with an inner side and a lower part, a resistance ring being arranged between said upper part and said lower part, a first contact area being provided on said inner side of said upper part, a second contact area being provided internally in the lower part, the switching mechanism producing, in temperature-dependent fashion, an electrically conductive connection between the first and second contact areas, said movable contact area interacting with said first contact area, the bimetallic snap-action disc lifting off the movable contact area from said first contact area depending on the temperature of said bimetallic snap-action disc, said resistance ring being arranged electrically in series with said current transfer element between said first and second contact areas when the switch is in its closed state, wherein the resistance ring comprises an upper ring area and a lower ring area, the current transfer element comprising a rim resting on the upper ring area, the lower ring area resting indirectly or directly on the second contact area, and wherein said upper ring area comprises a first section and said lower ring area comprises a second section, said first and second sections being provided with an electrically conductive coating having a lower specific electrical resistance than the material of the resistance ring.

19. A resistance ring for a temperature-dependent switch, said resistance ring comprising an upper ring area and a lower ring area and being manufactured from a material that has a specific electrical resistance at 20° C. that is greater than that of copper, wherein the upper ring area comprises a first section and the lower ring area comprises a second section, said first and second sections being provided with an electrically conductive coating, which has a lower specific electrical resistance than the material of the resistance ring, and wherein the first section is circumferentially offset with respect to the second section.

* * * * *